US007695573B2

(12) United States Patent
Cooper et al.

(10) Patent No.: US 7,695,573 B2
(45) Date of Patent: Apr. 13, 2010

(54) METHOD FOR PROCESSING ALLOYS VIA PLASMA (ION) NITRIDING

(75) Inventors: Clark VanTine Cooper, Glastonbury, CT (US); Krassimir G. Marchev, Sudbury, MA (US); Bill C. Giessen, Cambridge, MA (US); Raymond C. Benn, Madison, CT (US); Edward H. Bittner, Madison, CT (US); Harsh Vinayak, Meriden, CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 1307 days.

(21) Appl. No.: 10/937,100

(22) Filed: Sep. 9, 2004

(65) Prior Publication Data

US 2006/0048858 A1 Mar. 9, 2006

(51) Int. Cl.
*C23C 8/24* (2006.01)
*C23C 8/48* (2006.01)
*C23C 22/00* (2006.01)

(52) U.S. Cl. ..... 148/238; 148/317

(58) Field of Classification Search ..... 148/238, 148/328, 317
See application file for complete search history.

(56) References Cited

U.S. PATENT DOCUMENTS 4,119,443 A 10/1978 Abe
5,102,476 A 4/1992 Wahl
5,268,044 A * 12/1993 Hemphill et al. ..... 148/328
5,306,531 A * 4/1994 Laurence et al. ..... 427/569
5,599,404 A 2/1997 Alger
5,851,313 A 12/1998 Milam
6,179,933 B1 1/2001 Dodd
6,660,340 B1 12/2003 Kirkpatrick
6,767,414 B2 * 7/2004 Uehara et al. ..... 148/318
2003/0226625 A1 12/2003 Kuehmann et al.
2005/0279426 A1 12/2005 Cooper et al.
2006/0048857 A1 3/2006 Cooper et al.

OTHER PUBLICATIONS

Gomes et al. ("Alternated High- and Low-Pressure Nitriding of Austenitic Stainless Steel: Mechanisms and Results", Journal of Applied Physics, vol. 94, No. 9, Nov. 1, 2003, pp. 1-5).*
Gomes et al. ("Alternative High-and Low-Pressure Nitriding of Austenitic Stainless Steel: Mechanisms and Results", Journal of Applied Physics, vol. 94, No. 9, Nov. 1, 2003, pp. 1-5.

(Continued)

*Primary Examiner*—Roy King
*Assistant Examiner*—Weiping Zhu
(74) *Attorney, Agent, or Firm*—Carlson, Gaskey & Olds PC

(57) ABSTRACT

A surface processing method and power transmission component includes transforming a surface region of a metal alloy into a hardened surface region at a temperature that is less than a heat treating temperature of the metal alloy. The metal alloy includes about 11.1 wt % Ni, about 13.4 wt % Co, about 3.0 wt % Cr, about 0.2 wt % C, and about 1.2 wt % Mo which reacts with the C to form a metal carbide precipitate of the form $M_2C$. The surface processing temperature, vacuum pressure, precursor gas flow and ratio, and time of processing are controlled to provide a desirable hardened surface region having a gradual transition in nitrogen concentration.

12 Claims, 3 Drawing Sheets

OTHER PUBLICATIONS

Helena Ronkainen (Tribological Properties of Hydrogenated and Hydrogen-Free Diamond-Like Carbon Coatings, VTT Publication 434, 2001).

Gregory B. Olson, Morris Azrin, Edward S. Wright, "Innovations in Ultrahigh-strength Steel Technology," Proceedings of the 34th Sagamore Confenence held Aug. 30-Sep. 3, 1987, Lake George, NY pp. 89-111.

* cited by examiner

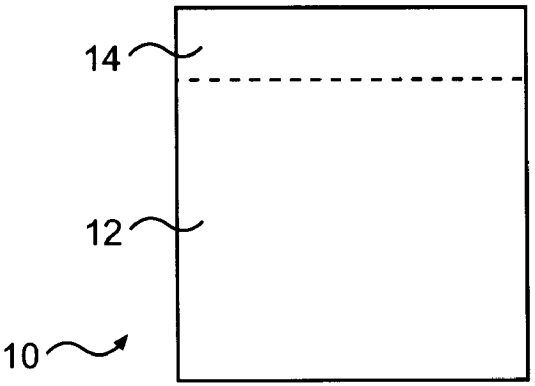
FIG. 1
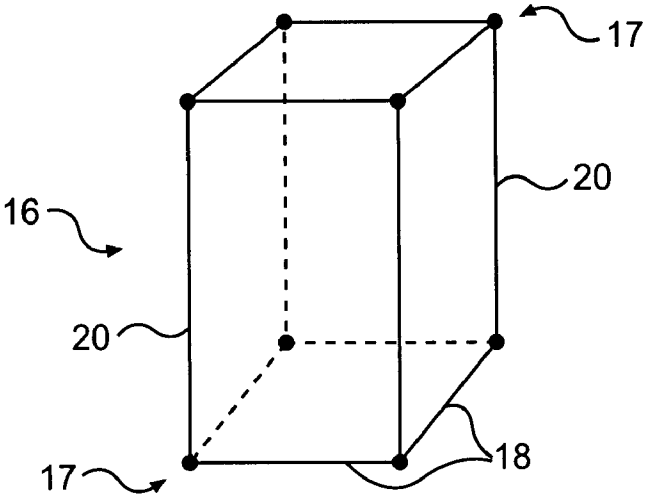
FIG. 2
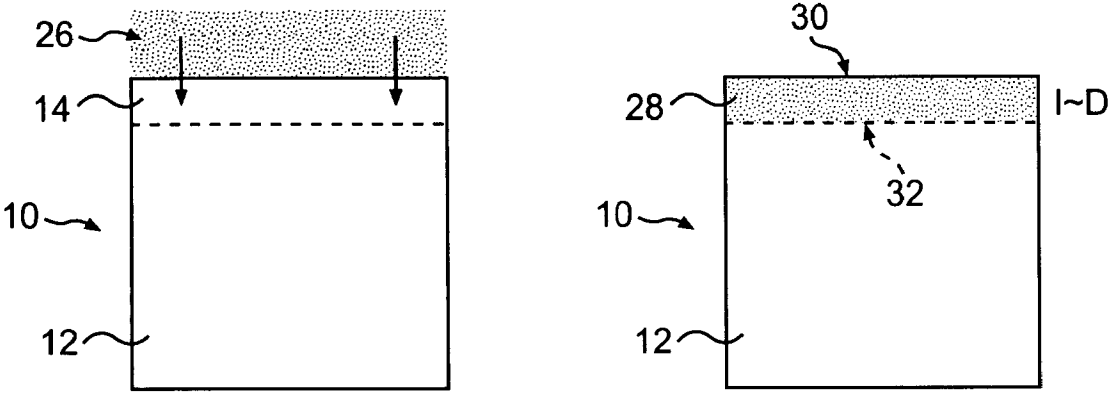
FIG. 3
FIG. 4
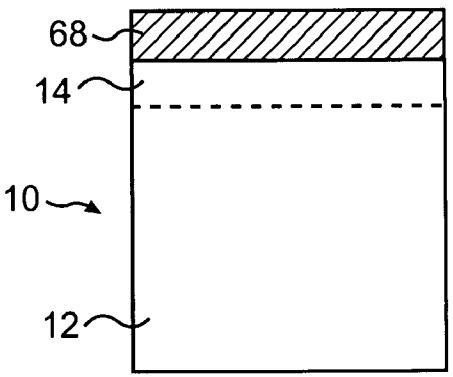
FIG. 7

METHOD FOR PROCESSING ALLOYS VIA PLASMA (ION) NITRIDING

BACKGROUND OF THE INVENTION

This invention relates to surface processing of a power transmission component and, more particularly, to methods of surface processing that minimize dimensional alteration and the identification of alloys that possess properties and microstructures conducive to surface processing in such a way that the processed alloy possesses desirable surface and core properties that render it particularly effective in applications that demand superior properties such as power transmission components. Absent the combination of alloy selection and processing that are taught herein, such superior properties would be unavailable.

For iron-based metal alloy components, such as power transmission components, it is often desirable to form a hardened surface case around the core of the component to enhance component performance. The hardened surface case provides wear and corrosion resistance while the core provides toughness and impact resistance.

There are various conventional methods for forming a hardened surface case on a power transmission component fabricated from a steel alloy. One conventional method, nitriding, utilizes gas, salt bath or plasma processing. The nitriding process introduces nitrogen to the surface of the component at an elevated temperature. The nitrogen reacts with the steel alloy to form the hardened surface case while the core of the component may retain the original hardness, strength, and toughness characteristics of the steel alloy. This conventional process provides a hardened surface case, however, the elevated temperatures of the nitriding process may over-temper the core and diminish its properties and/or induce dimensional distortion of the component such that additional grinding or dimensionalizing steps are required to bring the component into dimensional tolerance.

Accordingly, it is desirable to identify a particular alloy for a surface processing method that minimizes dimensional alteration of a power transmission component and essentially eliminates dimensionalizing processes subsequent to the case hardening process.

SUMMARY OF THE INVENTION

The surface processing method and power transmission component according to the present invention includes transforming by plasma-ion processing a surface region into a hardened surface region at a temperature that is less than a tempering temperature of the metal alloy.

The Fe-based metal alloy includes about 11.1 wt % Ni, about 13.4 wt % Co, about 3.0 wt % Cr, about 0.2 wt % C, and about 1.2 wt % of a carbide-forming element, Mo, which reacts with the carbon to form a metal carbide precipitate of the form $M_2C$. The temperature, vacuum pressure, precursor gas flow and ratio, and time of plasma (ion) processing are controlled to provide a hardened surface having a gradual transition in nitrogen concentration. A temperature below the heat treating temperature of the metal alloy is utilized to maintain the crystal structure and metal alloy dimensions through the process The metal alloy and plasma (ion) surface processing method according to the present invention minimize dimensional alteration of a power transmission component and essentially eliminate subsequent dimensionalizing processes.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

FIG. 1 shows a schematic view of a metal alloy;

FIG. 2 shows a schematic view of a crystal structure;

FIG. 3 shows a schematic view of a metal alloy during surface processing;

FIG. 4 shows a schematic view of a metal alloy and hardened surface region;

FIG. 7 shows a schematic view of a nitride compound on a surface region of a metal alloy;

DETAILED DESCRIPTION OF THE PREFERRED EMBODIMENT

Figure 5:
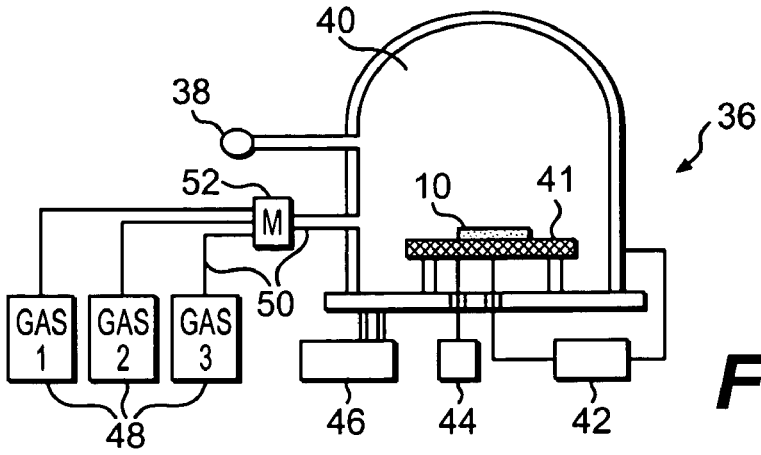
FIG. 5 shows a schematic view of a plasma (ion) nitriding chamber.

FIG. 1 shows a schematic view of a metal alloy 10, including a core 12 and a surface region 14 on the core 12. The metal alloy 10 is an iron-based alloy that is generally nitrogen-free and has an associated composition and hardening heat treatment, including a tempering temperature. The tempering temperature is dependent on the metal alloy 10 composition and is the temperature at which the metal alloy is heat processed to alter characteristics of the metal alloy 10, such as hardness, strength, and toughness.

The composition of the metal alloy 10 is essentially a Ni—Co secondary hardening martensitic steel, which provides high strength and high toughness. That is, the ultimate tensile strength of the metal alloy 10 is greater than about 170 ksi and the yield stress is greater than about 140 ksi and in some examples the ultimate tensile strength is approximately 285 ksi and the yield stress is about 250 ksi. High strength and high toughness provide desirable performance in such applications as power transmission components. Conventional vacuum melting and remelting practices are used and may include the use of gettering elements including, for example, rare earth metals, Mg, Ca, Si, Mn and combinations thereof, to remove impurity elements from the metal alloy 10 and achieve high strength and high toughness. Impurity elements such as S, P, O, and N present in trace amounts may detract from the strength and toughness.

Preferably, the alloy content of the metal alloy 10 and the tempering temperature satisfy the thermodynamic condition that the alloy carbide, $M_2C$ where M is a metallic carbide-forming element, is more stable than $Fe_3C$ (a relatively coarse precursor carbide), such that $Fe_3C$ will dissolve and $M_2C$ alloy carbides precipitate. The $M_2C$ alloy carbide-forming elements contribute to the high strength and high toughness of the metal alloy 10 by forming a fine dispersion of $M_2C$ precipitates that produce secondary hardening during a conventional, precipitation heat treatment process prior to any surface processing. The preferred alloy carbide-forming element is Mo, which combines with carbon in the metal alloy 10 to form $M_2C$. Preferably, the metal alloy 10 includes about 11.1 wt % Ni, about 13.4 wt % Co, about 3.0 wt % Cr, about 0.2 wt % C, and about 1.2 wt % of the carbide-forming element Mo. The carbide-forming element Mo reacts with the C to form a metal carbide precipitate of the form $M_2C$.

The carbide-forming element Mo provides strength and toughness advantages by forming a fine dispersion of $M_2C$. Certain other possible alloying elements such as Al, V, W, Si, Cr, may also form other compounds such as nitride compounds. These alloying elements and the carbide-forming element Mo influence the strength, toughness, and surface hardenability of the metal alloy 10.

Typically, metal alloy 10 is hardened by heat treating above ~1500° F. in the austenite phase region (austenitizing) to re-solution carbides etc. It is then quenched and refrigerated at approximately −100° F. to transform the austenite structure to martensite. The latter is a very hard, brittle, metastable phase having a body centered tetragonal (BCT) crystal structure because of the entrapped carbon atoms. Hence, at this stage, the core 12 and surface region 14 of the metal alloy 10 have a generally equivalent tetragonal crystal structure 16 (FIG. 2).

As illustrated in FIG. 2, the tetragonal crystal structure 16 includes atomic lattice sites 17 forming sides having length 18 which are essentially perpendicular to sides having length 20. In the tetragonal crystal structure 16, the length 18 does not equal the length 20. Subsequent aging heat treatments are used to both soften the martensite structure and also transform the $Fe_3C$ phase to $M_2C$ which strengthens the structure. The latter reaction tends to dominate, leading to secondary hardening. These reactions can lead to concomitant changes in crystal structure as the metastable martensitic BCT structure transitions to other phases, such as austenite and/or ferrite depending on the exposure temperature and time. It is to be understood that the iron-based alloy may be formed instead with other crystal structures such as, but not limited to, face centered cubic (e.g. austenite) and body centered cubic (e.g. ferrite). These phase transitions may lead to dimensional changes.

FIG. 3 shows a schematic cross-sectional view of the metal alloy 10 during transformation of the surface region 14 into a hardened surface region 28 as illustrated in FIG. 4. A plasma (ion) nitriding process is used to form the hardened surface region.

The plasma (ion) nitriding process is conducted in an appropriate reactor, an example of which is illustrated schematically in FIG. 5. The metal alloy 10 is placed in the plasma (ion) nitriding chamber 36 on a cathode 41. The cathode 41 provides a DC bias potential to the metal alloy 10, thereby heating the metal alloy 10 to a desired nitriding temperature that is below the heat treating temperature, such as the aging or tempering temperature, of the metal alloy 10.

Heating the metal alloy 10 to a temperature above the heat treating temperature may alter the incumbent crystal structure 16, relieve residual stresses in the metal alloy 10, otherwise undesirably alter the microstructure and properties of the core, and undesirably alter the dimensions of the metal alloy 10. By utilizing a temperature below the heat treating temperature of the metal alloy 10, the strength, toughness, incumbent crystal structure 16, and dimensions of the metal alloy 10 are maintained through plasma (ion) nitriding processes. Subsequent processes to dimensionalize the metal alloy 10 or a power transmission component formed from the metal alloy 10 are eliminated. For the preferred metal alloy 10 composition, the heat treating temperature is about 900° F. For other compositions, the heat treating temperature may be different.

The plasma (ion) nitriding chamber 36 includes a vacuum pump 38 which maintains a vacuum in an inner chamber 40 of the plasma (ion) nitriding chamber 36. An electric current device 42 provides electric current to the cathode 41. A thermocouple 44 attached to the cathode 41 detects the cathode temperature and a cooling system 46 provides cooling capability to control the inner chamber 40 temperature. The inner chamber 40 is in fluid communication with the precursor gas storage tanks 48. The precursor gas storage tanks 48 may include gases such as nitrogen, hydrogen, and methane, although it should be noted that these gases are not all necessarily utilized during the high current density ion implantation nitriding process. The conduit 50 connects the precursor gas storage tanks 48 to the inner chamber 40 and includes a gas metering device 52 to control the gas flow from the gas storage tanks 48.

The temperature, vacuum pressure in the inner chamber 40, precursor gas flow and ratio, and time of processing are controlled during the plasma (ion) nitriding process to provide a hardened surface region 28 (FIG. 4) on the metal alloy 10. The preferred conditions include a temperature between 700° F. and about 1000° F., a pressure between about 0.1 torr and 7.5 torr in the inner chamber 40, a precursor gases ratio of nitrogen and hydrogen, and for a time of about twelve hours. Even more preferably, the conditions are controlled to a temperature of about 850° F., a pressure of 0.75 torr in the inner chamber 40, a precursor gas ratio of 10% nitrogen and 90% hydrogen, and for a time of about twelve hours. Additionally, when the plasma (ion) nitriding process conditions, such as temperature and time, are essentially equal to the tempering/aging heat treatment conditions, then the two processes may be combined into one process.

Under the preferred conditions, nitrogen from the nitrogen atmosphere 26 (FIG. 3) in the inner chamber 40 diffuses into the surface region 14 of the metal alloy 10. The nitrogen interstitially diffuses into the surface region 14, thereby hardening the surface region 14 and transforming the surface region 14 into the hardened surface region 28. Preferably, the hardened surface region 28 has a gradual transition in nitrogen concentration over a depth D between an outer surface 30 of the hardened surface region 28 and an inner portion 32 of the hardened surface region 28.

Figure 6A:
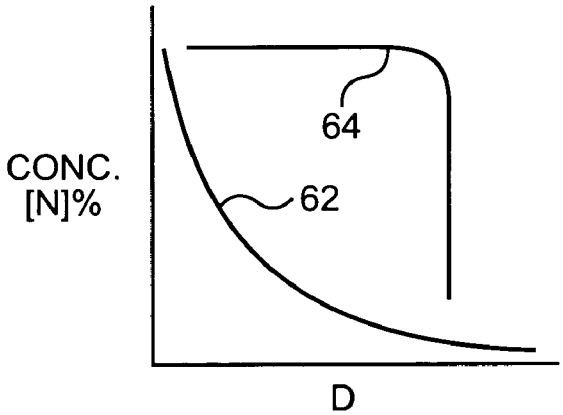
FIG. 6A shows a nitrogen concentration profile over a depth of a hardened surface region.

The line 62 in FIG. 6A illustrates a gradual nitrogen concentration profile over the depth D. By comparison, the line 64 represents the nitrogen concentration profile of a generally abrupt nitrogen concentration. For the line 62, at a shallow depth into the hardened surface region 28 such as near the outer surface 30, the nitrogen concentration is relatively high compared to the nitrogen concentration in the core 12. At a deeper depth, such as near the inner portion 32, the nitrogen concentration is relatively low and approaches the nitrogen concentration of the core 12. It is to be understood that a variety of nitrogen concentration profiles may result from varying the preferred conditions.

Figure 6B:
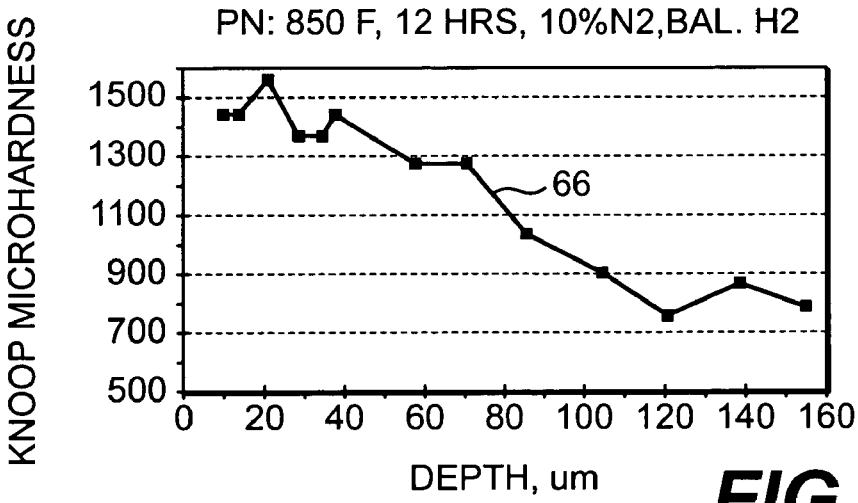
FIG. 6B shows a Knoop hardness profile over a depth of a hardened surface region.

The line 66 in FIG. 6B represents the Knoop hardness profile through the depth D of the hardened surface region 28. The gradual nitrogen concentration profile over the depth D is manifested by a gradual change in Knoop hardness through the depth D rather than an abrupt change in hardness. At a shallow depth into the hardened surface region 28 such as near the outer surface 30, the nitrogen concentration is relatively high and results in high hardness compared to the core 12. At a deeper depth, such as near the inner portion 32, the nitrogen concentration is relatively low and the hardness approaches the hardness of the core 12. It is to be understood that a variety of Knoop hardness profiles may result from varying the conditions within the preferred conditions.

Figure 8A:
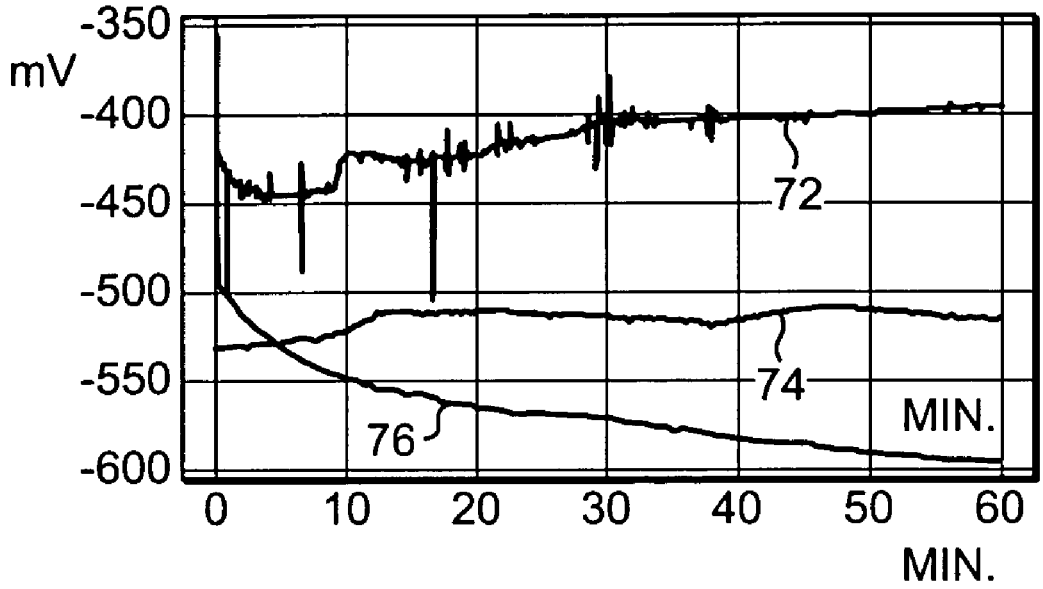
FIG. 8A shows corrosion cell voltage versus time.
Figure 8B:
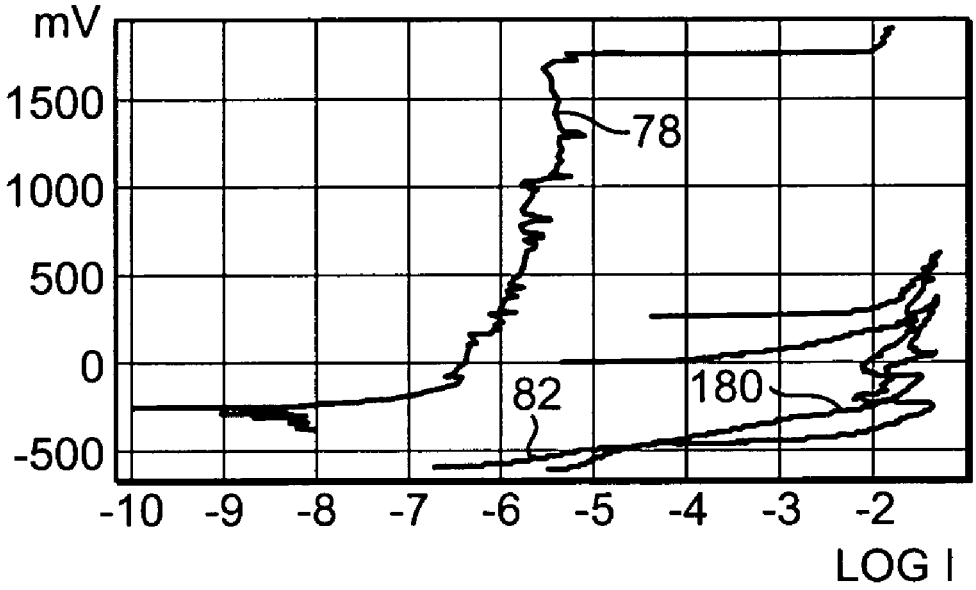
FIG. 8B shows corrosion pitting resistance.

FIG. 7 shows a schematic view of a metal alloy 10 after another plasma (ion) nitriding process. Utilizing a temperature towards the ends of the preferred range of 700° F. and about 1000° F. or utilizing an additional gas such as methane may result in the formation of a compound 68 of iron and nitrogen, such as the γ' or ϵ compounds, on the surface region 14. Formation of the compound 68 is generally not preferred if a coating will be subsequently deposited over the compound 68, however, the compound 68 does provide corrosion resistance for the metal alloy 10 as illustrated in FIGS. 8A-8B respectively showing open cell voltage versus time and pitting corrosion resistance. The line 72 represents the open cell corrosion resistance of a metal alloy with an ϵ compound. Likewise, the lines 74 and 76 respectively represent a metal alloy with a γ' compound and the metal alloy with no compound. The line 78 represents the pitting corrosion resistance of a metal alloy with an ϵ compound. Likewise, the lines 80 and 82 respectively represent a metal alloy 10 with a γ' compound and the metal alloy 10 with no compound.

Additionally, alloying elements such as Al, V, W, Si, and Cr may be present in the metal alloy 10. Nitride compounds containing the alloying elements may form during the high current density ion implantation nitriding process. The presence of the nitride compounds is generally detrimental to the mechanical properties of the metal alloy 10 and are particularly detrimental in a complex with iron nitride compounds that may be formed under certain high current density ion implantation nitriding processing conditions, however, the presence of these alloying elements may be required to acquire other characteristics in the metal alloy 10.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A surface processing method comprising:

(a) transforming by plasma-ion processing a surface region of a metal alloy into a hardened surface region at a temperature which is less than a heat treating temperature of the metal alloy, wherein the metal alloy comprises about 13.4 wt % cobalt, about 11.1 wt % nickel, about 0.2 wt % carbon, about 3.0 wt % chromium, and about 1.2 wt % molybdenum.

2. The method as recited in claim 1, further comprising the step of nitriding the surface region by high current density ion implantation to form the hardened surface region.

3. The method as recited in claim 1, further comprising transforming the surface region into a nitrogen-containing solid solution surface region.

4. The method as recited in claim 1, further comprising the step of using a gas atmosphere comprising between about 10% and 100% nitrogen to transform the surface region.

5. The method as recited in claim 1, further comprising the step of using a gas atmosphere pressure between 0.1 torr and 7.5 torr to transform the surface region.

6. The method as recited in claim 1, wherein said step (a) further comprises transforming the surface region of a metal alloy into the hardened surface region at a temperature of between 700° F. and about 1000° F.

7. The method as recited in claim 1, further comprising the step of using a gas atmosphere pressure of about 0.75 torr to transform the surface region.

8. The method as recited in claim 1, wherein said step (a) further comprises transforming the surface region into the hardened surface region, where the hardened surface region includes a Knoop hardness of at least 1400.

9. A surface processing method comprising the steps of:

(a) providing a metal alloy with an associated composition and associated heat treating temperature, wherein the metal alloy comprises about 13.4 wt % cobalt, about 11.1 wt % nickel, about 0.2 wt % carbon, about 3.0 wt % chromium, and about 1.2 wt % molybdenum; and (b) transforming by plasma-ion processing a surface region of the metal alloy to a hardened surface region at a temperature less than the heat treating temperature of the metal alloy.

10. The method as recited in claim 9, further comprising the step of using a gas atmosphere pressure of about 0.75 torr to transform the surface region.

11. The method as recited in claim 9, wherein said step (b) further comprises transforming the surface region into the hardened surface region, where the hardened surface region comprises a Knoop hardness of at least 1400.

12. A power transmission component comprising:

a metal alloy core comprising an associated composition comprising about 13.4 wt % cobalt, about 11.1 wt % nickel, about 3.0 wt % chromium, about 0.2 wt % carbon, and about 1.2 wt % molybdenum; and a plasma-ion induced nitrogen-containing solid solution region on said metal alloy core having a gradual transition in nitrogen concentration between an outer surface of said nitrogen-containing solid solution region and said metal alloy core.

* * * * *